US007150455B2

(12) United States Patent
Furukawa et al.

(10) Patent No.: US 7,150,455 B2
(45) Date of Patent: Dec. 19, 2006

(54) SHEET CONVEYING DEVICE

(75) Inventors: Gentaro Furukawa, Kanagawa (JP); Hiroyuki Kohda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 14 days.

(21) Appl. No.: 10/865,782

(22) Filed: Jun. 14, 2004

(65) Prior Publication Data

US 2005/0017442 A1 Jan. 27, 2005

(30) Foreign Application Priority Data

Jun. 12, 2003 (JP) ..... 2003-167851

(51) Int. Cl.
*B65H 5/34* (2006.01)

(52) U.S. Cl. ..... 271/270; 271/265.02

(58) Field of Classification Search ..... 271/265.01, 271/265.02, 265.03, 266, 270, 202, 259, 271/291, 186; 396/616, 612, 613; 226/122
See application file for complete search history.

(56) References Cited

U.S. PATENT DOCUMENTS 4,331,328 A * 5/1982 Fasig ..... 271/270
4,451,027 A * 5/1984 Alper ..... 271/10.02
4,780,745 A * 10/1988 Kodama ..... 399/401
5,104,110 A * 4/1992 Haibara ..... 271/9.02
6,644,660 B1 * 11/2003 Sussmeier et al. ..... 271/270

FOREIGN PATENT DOCUMENTS

JP 2002-179266 A 6/2002

* cited by examiner

*Primary Examiner*—Patrick Mackey
*Assistant Examiner*—Kaitlin Joerger
(74) *Attorney, Agent, or Firm*—Sughrue Mion, PLLC

(57) ABSTRACT

In order to accurately maintain an interval between a preceding sheet and a subsequent sheet, a sheet conveying device effects control such that, under the condition that a trailing end sensor disposed on a conveying path for supply has detected a trailing end of the preceding sheet, the subsequent sheet is conveyed at a high-speed conveying speed at a fixed time, and such that, under the condition that a leading end sensor has detected a leading end of a sheet, switches a detected sheet from the high-speed to a low-speed conveying speed at a fixed time and conveys the detected sheet.

2 Claims, 14 Drawing Sheets

SHEET CONVEYING DEVICE

CROSS-REFERENCE TO RELATED APPLICATION

This application claims priority under 35 USC 119 from Japanese patent Application No.2003-167851, the disclosure of which is incorporated by reference herein.

BACKGROUND OF THE INVENTION

1. Technical Field

The present invention relates to a sheet conveying device which is excellent for application to image forming devices which, while successively conveying sheet-shaped recording media at uniform intervals, carry out processings for forming images onto the respective sheets.

2. Description of the Related Art

Generally, there are image forming devices and image reading devices which are provided with sheet conveying devices. The sheet conveying device is for conveying sheet-shaped image recording media, which are stocked in a supplying section, to a processing section which carries out various processings such as image forming processing, reading processing, or printing processing.

For example, among sheet conveying devices used in image reading devices such as copiers, fax machines, image scanners and the like, there are sheet conveying devices which separate, one-by-one, sheet documents which are stacked in a sheet supply tray, and automatically convey and supply the sheet documents to an image reading section.

In such a sheet conveying device, when the speed at which the sheet documents are supplied and the document reading speed in the image reading section are different, the interval between the sheet documents is no longer maintained at an appropriate uniform interval in the image reading section. Namely, if the document reading speed in the image reading section is fast, the interval between the sheet documents becomes long, and there is the concern that the time over which the sheet documents are processed will become long. Conversely, if the document reading speed in the image reading section is slow, the interval between the sheet documents becomes short, and there is the concern that a subsequent sheet document will collide with a preceding sheet document such that abnormalities in conveying will arise.

Therefore, conventional sheet conveying devices are provided with: sheet supplying means for supplying sheet documents toward a predetermined position; conveying means for continuously causing a preceding sheet document and a subsequent sheet document supplied from the sheet supplying means to pass through the predetermined position; setting means for computing and setting an interval between the preceding sheet document fed by the conveying means and the subsequent sheet document fed by the sheet supplying means, from a feed amount of the preceding sheet document and a feed amount of the subsequent sheet document within a predetermined period of time; and supplied sheet driving means for controlling driving of the time of the start of operation of the sheet supplying means, on the basis of the interval set by the setting means, wherein the intervals between the sheet documents successively passing through the predetermined position is reliably held constant, and the speed for processing the sheet documents is shortened (see, for example, Japanese Patent Application Laid-Open (JP-A) No. 2002-179266).

In such a sheet conveying device used in an image forming device or an image reading device, when an attempt is made to effect control such that the sheet documents are conveyed at a faster speed, it is difficult to, on the basis of the feed amount of the preceding sheet document and the feed amount of the subsequent sheet document within the predetermined time period computed at the setting means, effect control such that the preceding sheet document and the subsequent sheet document do not contact one another. Moreover, if the sheet conveying device is structured so as to carry out switching-back on the conveying path of the sheet documents, it is difficult for the setting means to compute the feed amount of the preceding sheet document and the feed amount of the subsequent sheet document within the predetermined time period. In addition, when the sizes (the conveying direction lengths) of the sheet documents change, it is difficult to effect control such that the interval between the preceding sheet document and the subsequent sheet document is uniform.

SUMMARY OF THE INVENTION

In view of the aforementioned, an object of the present invention is to newly provide a sheet conveying device which can accurately convey sheet-shaped recording media successively at uniform intervals, and which can, even when the sizes of the sheet-shaped recording media change, keep constant the intervals between sheet-shaped recording media which are conveyed before and after with respect to one another.

A sheet conveying device of a first aspect of the present invention comprises: a conveying path for supply which can convey a plurality of sheets while switching to one of a high-speed conveying speed and a low-speed conveying speed in a specific section; a leading end portion detecting sensor disposed on the conveying path for supply; a trailing end portion detecting sensor disposed on the conveying path for supply at a conveying direction downstream side of the leading end portion detecting sensor; and a control device which effects control so as to convey a subsequent sheet, which stands-by at a predetermined position, at the high-speed conveying speed under the condition that the trailing end portion detecting sensor has detected a trailing end of a preceding sheet which is conveyed at a low speed, and so as to decelerate and switch to the low conveying speed at a fixed time under the condition that the leading end portion detecting sensor has detected a leading end of the subsequent sheet.

A sheet conveying device of a second aspect of the present invention comprises: a conveying path for supply which can convey a plurality of sheets while switching to one of a high-speed conveying speed and a low conveying speed in a specific section; a both end portion detecting sensor disposed on the conveying path for supply; and a control device which effects control so as to convey a subsequent sheet at the high-speed conveying speed at a fixed time under the condition that the both end portion detecting sensor has detected a trailing end of a preceding sheet which is conveyed at a low speed, and so as to decelerate and switch to the low conveying speed at a fixed time under the condition that the both end portion detecting sensor has detected a leading end of the subsequent sheet.

In accordance with the above-described structures, in contrast to the preceding sheet which is conveyed at a low-speed conveying speed, control is carried out so as to start conveying of the subsequent sheet at a high-speed conveying speed, and the leading end of the subsequent sheet can be set in a state of being accurately positioned at a position which is set apart by a predetermined interval from the trailing end of the preceding sheet. Further, when the leading end of the subsequent sheet is set in the state of being accurately positioned at a position which is set apart by a predetermined interval from the trailing end of the preceding sheet, the conveying speed of the subsequent sheet is switched from the high-speed conveying speed to the low-speed conveying speed. The preceding sheet and the subsequent sheet are conveyed out in a state of being accurately set apart from one another at a given interval. Further, even in cases in which the conveying direction lengths of the preceding sheet and the subsequent sheet are different, the interval between the trailing end of the preceding sheet and the leading end of the subsequent sheet can accurately be maintained constant. Accordingly, it is possible to prevent the trailing end of the preceding sheet and the leading end of the subsequent sheet from contacting one another on the conveying path such that jamming occurs.

A sheet conveying device of a third aspect of the present invention comprises: a conveying path for supply which can convey a plurality of sheets while switching to one of a high-speed conveying speed and a low conveying speed in a specific section; a first end portion detecting sensor disposed on the conveying path for supply and detecting a leading end of the sheet; a second end portion detecting sensor disposed on the conveying path for supply at a conveying direction downstream side of the first end portion detecting sensor, and detecting the leading end of the sheet; and a control device which effects control so as to start conveying, at the high-speed conveying speed, of a subsequent sheet, which stands-by at a predetermined position, under the condition that the first end portion detecting sensor has detected the leading end of a preceding sheet, and so as to decelerate and switch to the low conveying speed at a fixed time under the condition that the second end portion detecting sensor has detected a leading end of the subsequent sheet.

A sheet conveying device of a fourth aspect of the present invention comprises: a conveying path for supply which can convey a plurality of sheets while switching to one of a high-speed conveying speed and a low conveying speed in a specific section; a both end portion detecting sensor disposed on the conveying path for supply; and a control device which effects control so as to start conveying a subsequent sheet at the high-speed conveying speed at a fixed time under the condition that the both end portion detecting sensor has detected a leading end of a preceding sheet, and so as to decelerate and switch to the low conveying speed at a fixed time under the condition that the both end portion detecting sensor has detected a leading end of the subsequent sheet.

In accordance with the above-described structures, in contrast to the preceding sheet which is conveyed at a low-speed conveying speed, control is carried out so as to convey the subsequent sheet at a high-speed conveying speed, and the leading end of the subsequent sheet can be set in a state of being accurately positioned at a position which is set apart by a predetermined interval from the leading end of the preceding sheet. Further, when the leading end of the subsequent sheet is set in the state of being accurately positioned at a position which is set apart by a predetermined interval from the leading end of the preceding sheet, the conveying speed of the subsequent sheet is switched from the high-speed conveying speed to the low-speed conveying speed. The preceding sheet and the subsequent sheet can be conveyed out in a state in which the leading end of the preceding sheet and the leading end of the subsequent sheet are accurately set apart from one another at a uniform interval. Further, even in cases in which the conveying direction lengths of the preceding sheet and the subsequent sheet are different, the interval between the leading end of the preceding sheet and the leading end of the subsequent sheet can accurately be maintained constant. Accordingly, it is possible to prevent the trailing end of the preceding sheet and the leading end of the subsequent sheet from contacting one another on the conveying path such that jamming occurs.

The above-described sheet conveying devices may have a switch-back standby section disposed at a conveying direction upstream side of the conveying path for supply, and conveying a sheet, which has been conveyed in, into a conveying path set between a pair of guide members by rollers for leading end standby which are controlled to be driven to rotate by the control device, and causing the sheet to standby in a state in which one end portion of the sheet is nipped by the rollers for leading end standby, and due to the control device effecting control so as to reversely rotate the rollers for leading end standby at a necessary time, the switch-back standby section conveys the sheet out onto the conveying path for supply.

The switch-back standby section makes the subsequent sheet standby at the switch-back standby section, and can start the conveying of the subsequent sheet on the conveying path for supply immediately in response to a control command of the control device. Accordingly, control for keeping the interval between the preceding sheet and the subsequent sheet constant is carried out, and an excellent conveying processing ability is exhibited.

DETAILED DESCRIPTION OF THE INVENTION

Hereinafter, embodiments relating to a sheet conveying device of the present invention will be described in detail with reference to the drawings. The sheet conveying device relating to the present embodiment is structured as a sheet conveying device which is installed within the main body of an image forming device carrying out heat developing transfer processing, and which conveys sheet-shaped recording media.

Figure 1:
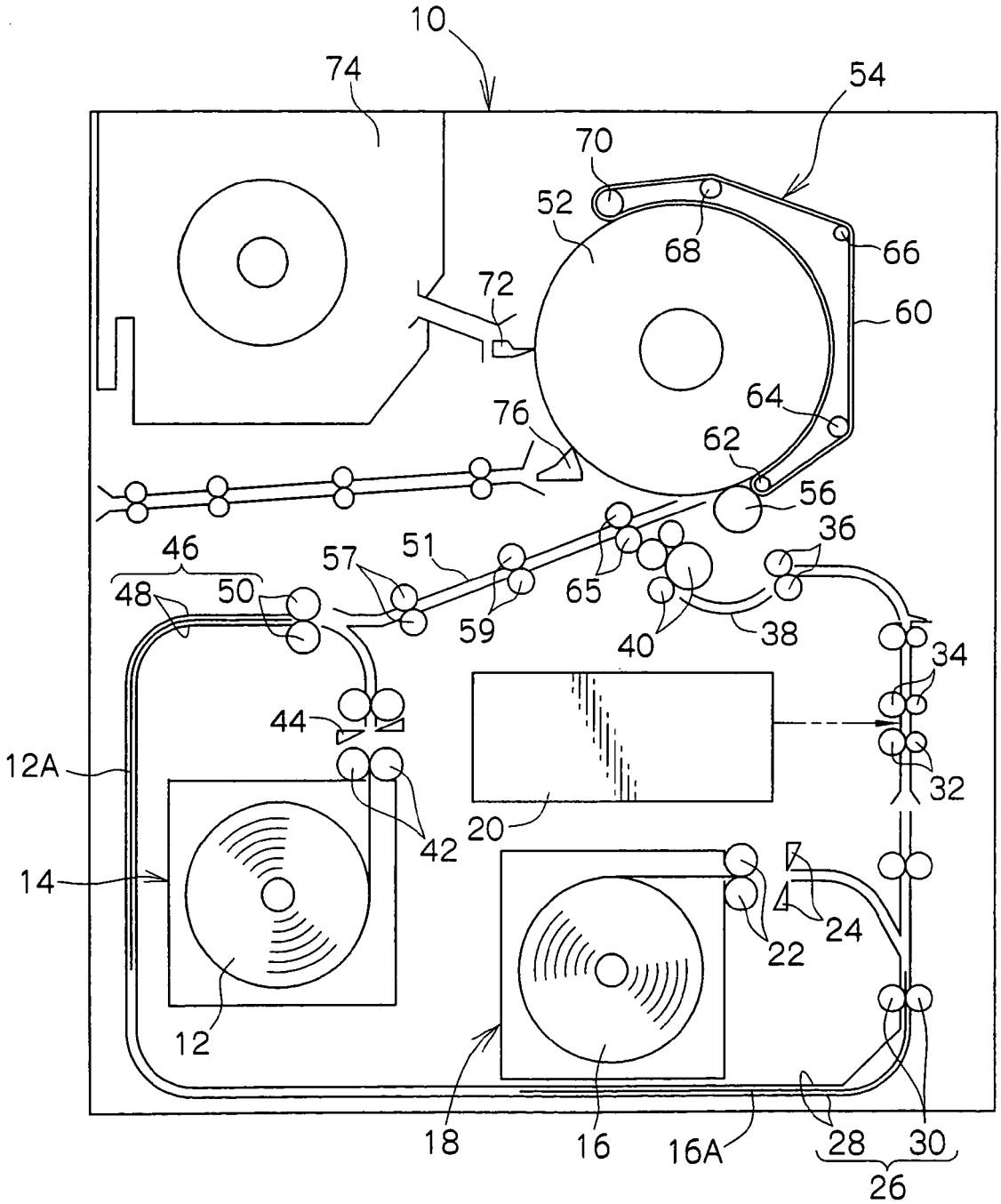
FIG. 1 is a schematic structural view showing an image forming device equipped with a sheet conveying device relating to an embodiment of the present invention.

As shown in FIG. 1, an image forming device main body 10 is structured as a laser exposure heat developing transfer type (silver halide photographic type) image forming device. The image forming device main body 10 prepares output prints by carrying out exposure processing, heat developing transfer processing, and the like, which are processing functions of image formation.

The image forming device main body 10 is structured so as to form an image while conveying a photosensitive material 16A and a image-receiving medium 12A, which are sheet-shaped recording media for image formation, in a roller conveying device at the interior of the image forming device main body 10.

An image-receiving paper magazine 14 and a donor magazine 18 are set in and utilized at the interior of the image forming device main body 10. The image-receiving paper magazine 14 serves as a sheet supplying section and houses an image-receiving paper roll 12 of a predetermined size (one sheet-shaped recording medium, e.g., a roll of OHP film or the like). The donor magazine 18 serves as a sheet supplying section and houses a donor roll 16 which is a photosensitive material of a predetermined size (another sheet-shaped recording medium).

In the image forming device main body 10, as a preparatory step for executing the exposure processing step, preparations are made by feeding, to a semiconductor unit 20, an image processing signal obtained by subjected an image data input signal to image processing.

In the image forming device, the leading end portion of the donor roll 16 housed in the donor magazine 18 is pulled out by a pair of pull-out rollers 22, and is cut into a photosensitive material 16A of a predetermined size (a size which is larger around the entire periphery thereof than an image-receiving medium 12A) by a cutter 24. Thereafter, the photosensitive material 16A is conveyed into a switch-back standby section 26.

The switch-back standby section 26 is structured in the form of a conveying path having a length which can accommodate the photosensitive material 16A along the entire length thereof. In the switch-back standby section 26, a pair of guide members 28 are disposed along the conveying path, and a pair of rollers 30 for leading end standby are disposed at the entrance thereof.

In the switch-back standby section 26 which is structured in this way, the photosensitive material 16A, which has been conveyed by the pull-out rollers 22, is conveyed in by the rollers 30 for leading end standby into the conveying path set between the pair of guide members 28. The photosensitive material 16A stands-by in a state in which one end portion of the photosensitive material 16A (the conveying direction trailing end portion at the time when the photosensitive material 16A is conveyed into the switch-back standby section 26) is nipped by the pair of rollers 30 for leading end standby.

The switch-back standby section 26 reversely rotates the rollers 30 for leading end standby at the time needed for the preparations for exposure processing at the semiconductor unit 20 to be made. The switch-back standby section 26 thereby conveys the photosensitive material 16A toward exposure rollers 32, 34 in an exposure processing section, with one end portion of the photosensitive material 16A leading (i.e., with the conveying direction trailing end portion, at the time when the photosensitive material 16A is conveyed into the switch-back standby section 26, leading).

Three-color simultaneous exposure processing is carried out by using a laser (LD) light source of the semiconductor unit 20, on the exposure surface of the photosensitive material 16A which is being conveyed through the exposure position between the pair of exposure rollers 32 and the pair of exposure rollers 34. Due to this exposure processing, the silver halide within the photosensitive material 16A reacts to the light such that a latent image is formed.

The photosensitive material 16A, on which a latent image has been formed in this way, is fed to a water applying section disposed downstream on the conveying path.

In the water applying section, the photosensitive material 16A is received by liquid application input rollers 36 and is fed into the interior of a liquid applying device 38. After a liquid (here, water) is applied onto the surface of the photosensitive material 16A by the liquid applying device 38, the photosensitive material 16A is conveyed to squeeze rollers 40, and the excess water remaining on the surface of the photosensitive material 16A is squeezed out. In this way, the photosensitive material 16A is in a state in which a predetermined small amount of water is applied uniformly to the surface of the photosensitive material 16A, and the photosensitive material 16A is conveyed to a heat developing transfer section at the downstream side in the conveying direction.

In the image forming device, simultaneously with the above-described operations, the leading end portion of the image-receiving paper roll 12 (which may be a roll of OHP film or the like) housed in the image-receiving paper magazine 14, is pulled-out by a pair of image-receiving paper pull-out rollers 42, and is cut into the image-receiving medium 12A of a predetermined size (a size which is smaller around the entire periphery thereof than the photosensitive material 16A) by a cutter 44. Thereafter, the image-receiving medium 12A is conveyed into a switch-back standby section 46 for the image-receiving paper.

The switch-back standby section 46 for the image-receiving paper is structured in the form of a conveying path having a length which can accommodate the image-receiving medium 12A along the entire length thereof. In the switch-back standby section 46 for the image-receiving paper, a pair of guide members 48 are disposed along the conveying path, and a pair of rollers 50 for leading end standby of the image-receiving paper are disposed at the entrance thereof.

Figure 2:
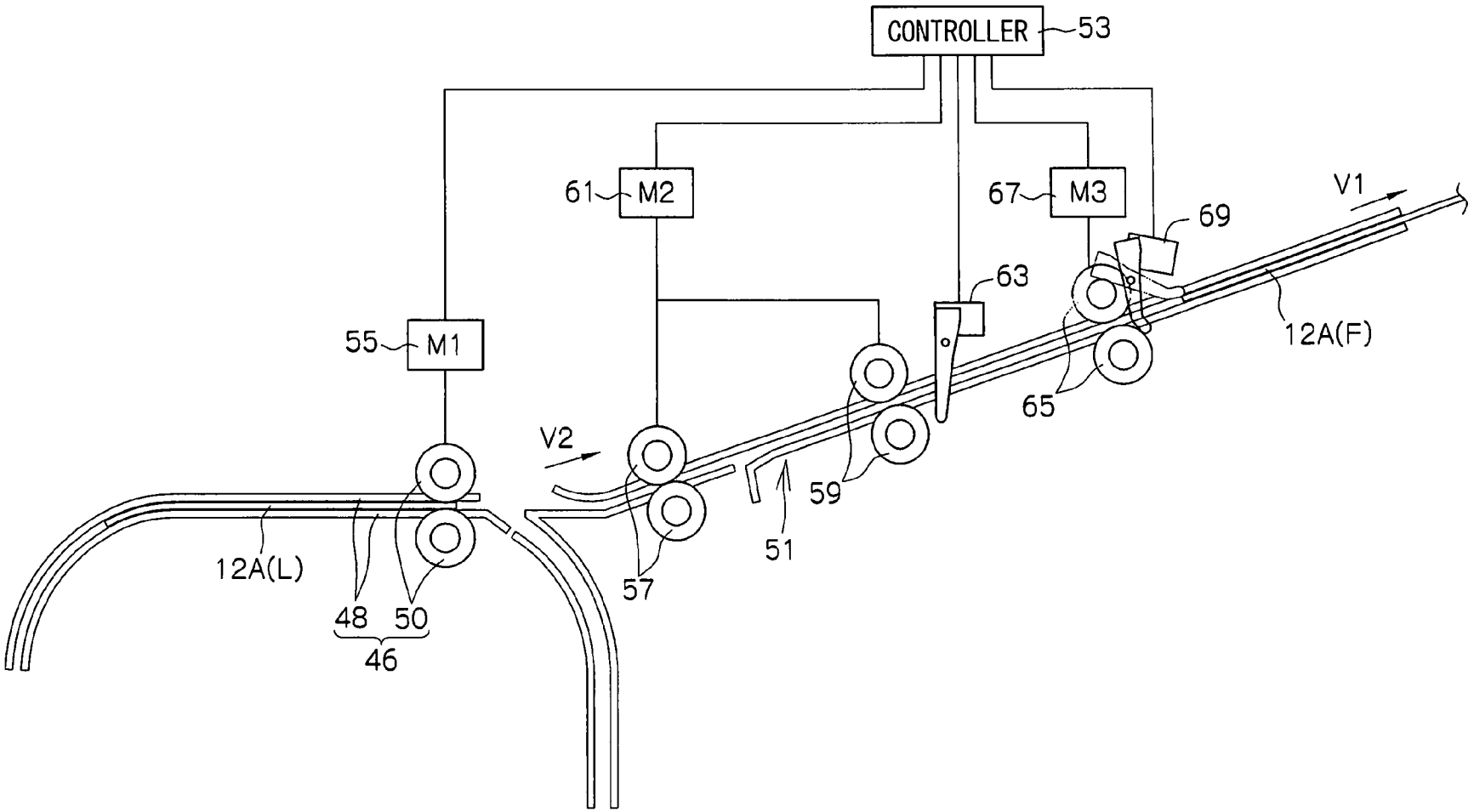
FIG. 2 is a schematic structural explanatory diagram at the time when a trailing end portion detecting sensor detects a preceding image-receiving medium, and shows main portions of the sheet conveying device provided at the image forming device relating to the embodiment of the present invention.

As shown in FIG. 2, the rollers 50 for leading end standby are connected to the output shaft of a forward/reverse driving motor 55 which is controlled by a control device 53, such that the rollers 50 for leading end standby are controlled to be driven to rotate either forward or reversely.

As shown in FIG. 1, in the switch-back standby section 46 for the image-receiving paper, the image-receiving medium 12A, which has been conveyed by the image-receiving paper pull-out rollers 42, is conveyed-in by the rollers 50 for leading end standby into a conveying path which is set between the pair of guide members 48. The image-receiving medium 12A stands-by in a state in which one end portion thereof (the conveying direction trailing end portion at the time when the image-receiving medium 12A is conveyed into the switch-back standby section 46) is nipped by the pair of rollers 50 for leading end standby.

Due to the switch-back standby section 46 for the image-receiving paper being controlled by the control device 53, the rollers 50 for leading end standby are rotated reversely at the time needed for completion of the preparations for the heat developing transfer processing of the photosensitive material 16A on which a latent image has been formed and to which water has been applied as described above. With one end portion of the image-receiving medium 12A leading (the conveying direction trailing end portion, at the time when the image-receiving medium 12A is conveyed into the switch-back standby section 46, leading), the image-receiving medium 12A is conveyed on a conveying path 51 for supply of the image-receiving paper, and is conveyed out to the heat developing transfer section.

As shown in FIG. 2, a sheet conveying control section, which carries out control for accurately conveying the image-receiving media 12A successively at uniform, short intervals, is structured at the portion of the sheet conveying device from the switch-back standby section 46 and extending over the conveying path 51 for supply. To this end, two sets of variable conveying rollers 57, 59 are disposed at a predetermined interval at the conveying direction downstream side of the rollers 50 for leading end standby. These variable conveying rollers 57, 59 are connected to the output shaft of a variable pulse motor 61 which is controlled by the control device 53, such that the conveying speeds thereof can be varied between V1 and V2.

A leading end portion detecting sensor 63 for detecting the leading end portion of the image-receiving medium 12A is disposed at an adjacent position at the conveying direction downstream side of the one set of variable conveying rollers 59. The leading end portion detecting sensor 63 is structured so as to transmit, to the control device 53, a detection signal at the time when the leading end portion detecting sensor 63 detects the leading end portion of the image-receiving medium 12A which is conveyed-in.

Feed-out conveying rollers 65 are disposed at a predetermined position from the leading end portion detecting sensor 63 at the conveying direction downstream side thereof.

The feed-out conveying rollers 65 are connected to the output shaft of a pulse motor 67 controlled by the control device 53 (a variable pulse motor is used in a case in which the conveying speed must be changed between V1 and V2). The feed-out conveying rollers 65 can convey the image-receiving medium 12A at a predetermined conveying speed (low speed) V1 at the time of heat developing transfer processing, which is synchronous with a drum 52 for heat developing in the heat developing transfer section which will be described later.

A trailing end portion detecting sensor 69 for detecting the trailing end portion of the image-receiving medium 12A is disposed at an adjacent position at the conveying direction downstream side of the feed-out conveying rollers 65. The trailing end portion detecting sensor 69 is structured so as to transmit, to the control device 53, a detection signal at the time when the trailing end portion detecting sensor 69 detects the trailing end portion of the image-receiving medium 12A which is conveyed-in.

Next, the control operations at the sheet conveying control section (which is structured as described above) at the time when the image-receiving media 12A are successively conveyed accurately at uniform, short intervals, will be explained with reference to FIGS. 2 through 4.

At the sheet conveying control section, the leading end portion of the image-receiving paper roll 12 housed in the image-receiving paper magazine 14 is pulled out, and the image-receiving paper roll 12 is cut to the image-receiving medium 12A of the predetermined size by the cutter 44. The image-receiving medium 12A is conveyed into the switch-back standby section 46 for the image-receiving paper, and stands-by in a state of being nipped by the rollers 50 for leading end standby. This image-receiving medium 12A is a preceding image-receiving medium 12A(F) which serves as a preceding sheet. The sheet conveying control section rotates the rollers 50 for leading end standby at the necessary time for preparations to be made for the heat developing transfer processing of the photosensitive material 16A, such that the preceding image-receiving medium 12A (F) is conveyed out toward the heat developing transfer section along the conveying path 51 for supply of the image-receiving paper.

Further, while the preceding image-receiving medium 12A(F) is being conveyed on the conveying path 51 for supply, the sheet conveying control section causes the leading end portion of the image-receiving paper roll 12 within the image-receiving paper magazine 14 to be pulled-out, and the image-receiving paper roll 12 to be cut by the cutter 44 and conveyed into the switch-back standby section 46 for the image-receiving paper and nipped by the rollers 50 for leading end standby. This image-receiving medium 12A is a subsequent image-receiving medium 12A(L) which serves as a subsequent sheet. The sheet conveying control section causes this subsequent image-receiving medium 12A(L) to stand-by at the switch-back standby section 46 for the image-receiving paper.

As shown in FIG. 2, at the sheet conveying control section, while the preceding image-receiving medium 12A (F) is conveyed along the conveying path 51 for supply of the image-receiving paper out to the heat developing transfer section, when the trailing end portion detecting sensor 69 detects the trailing end of the preceding image-receiving medium 12A(F), the trailing end portion detecting sensor 69 transmits a detection signal therefor to the control device 53.

Therefore, the control device 53, which has received the detection signal of the trailing end portion detecting sensor 69, drives the forward/reverse driving motor 55 at high speed such that the rollers 50 for leading end standby are rotated reversely, and the subsequent image-receiving medium 12A(L) is conveyed out onto the conveying path 51 for supply of the image-receiving paper at the predetermined high-speed conveying speed V2.

Moreover, the control device 53 drives the variable pulse motor 61. The variable conveying rollers 57, 59 are driven to rotate, and the subsequent image-receiving medium 12A (L) is conveyed along the conveying path 51 for supply of the image-receiving paper at the predetermined high-speed conveying speed V2.

Figure 3:
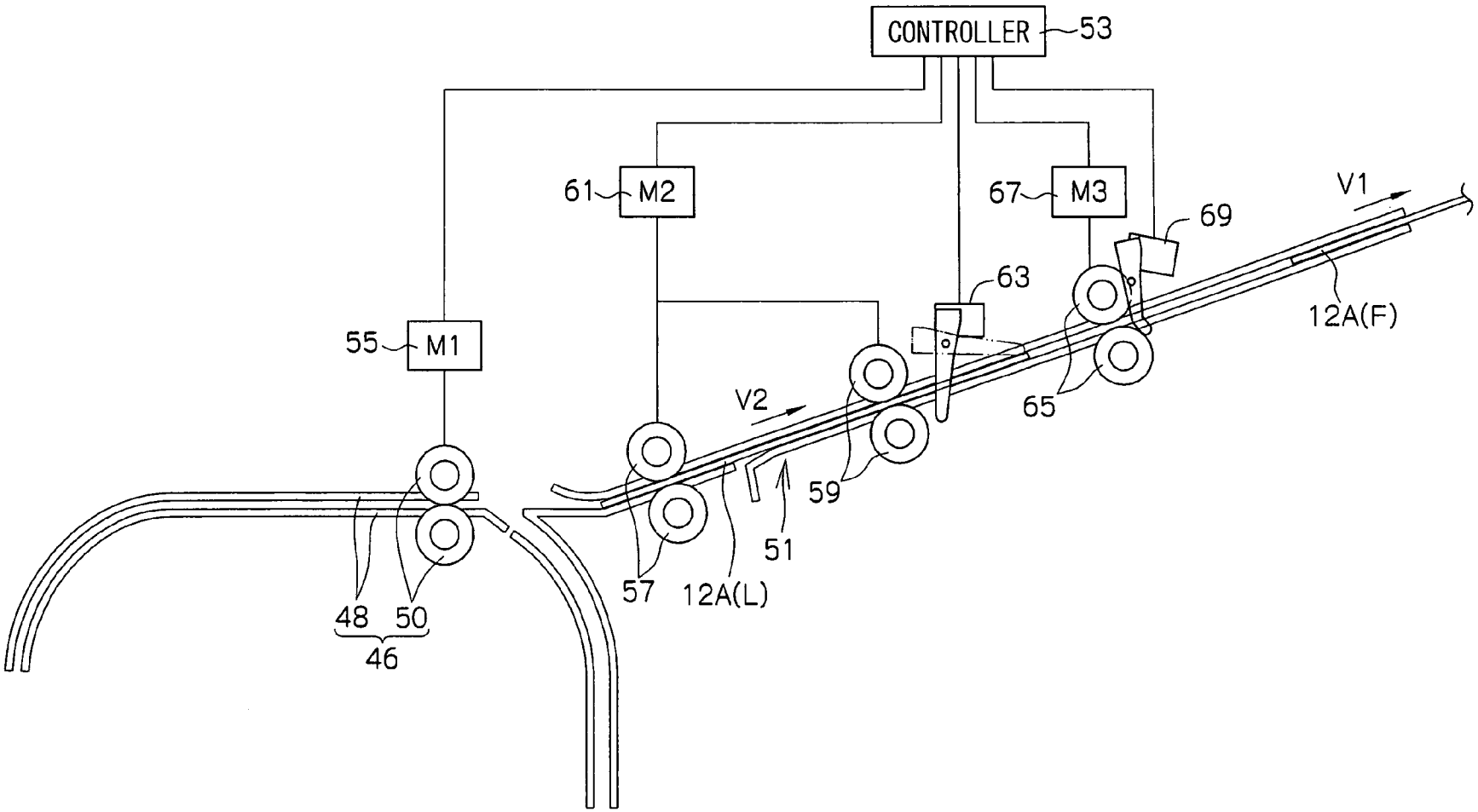
FIG. 3 is a schematic structural explanatory diagram at the time when a leading end portion detecting sensor detects a subsequent image-receiving medium, and shows main portions of the sheet conveying device provided at the image forming device relating to the embodiment of the present invention.

As shown in FIG. 3, when the leading end of the subsequent image-receiving medium 12A(L) which has been conveyed in at the high-speed conveying speed V2 is detected by the leading end portion detecting sensor 63 and the detection signal therefor is transmitted to the control device 53, the control device 53 of the sheet conveying control section drives, at a high speed and for a predetermined period of time, the variable pulse motor 61 (and the pulse motor 67 if necessary) from the point in time when the leading end portion detecting sensor 63 detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Note that, in this sheet conveying control section, control may be effected as follows: the control device 53 drives, at high speed and for a predetermined number of pulses, the variable pulse motor 61 (and the pulse motor 67 if necessary) from the point in time when the leading end portion detecting sensor 63 detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Figure 4:
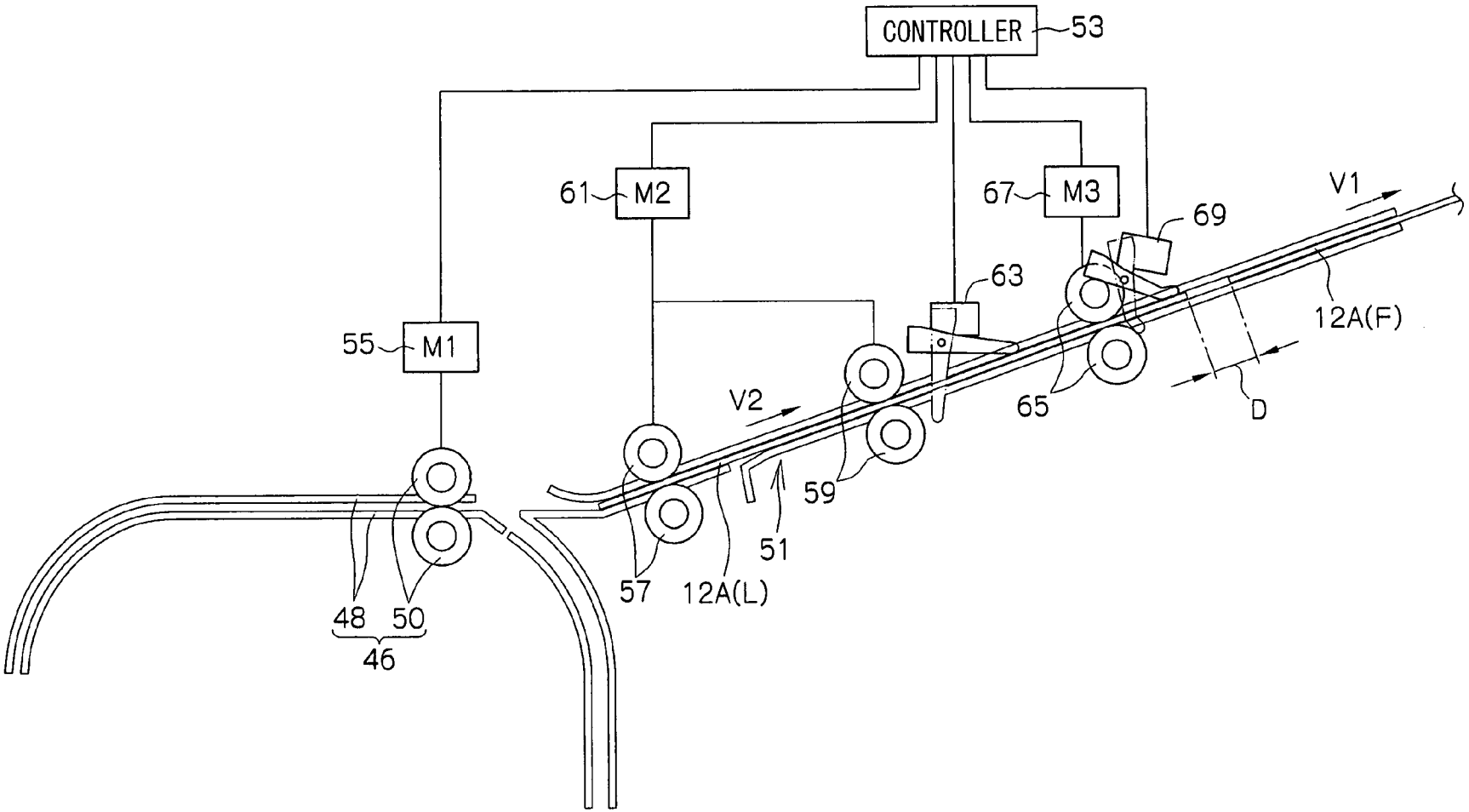
FIG. 4 is a schematic structural explanatory diagram at the time when the preceding image-receiving medium and the subsequent image-receiving medium become set at a predetermined interval from one another, and shows main portions of the sheet conveying device provided at the image forming device relating to the embodiment of the present invention.

As shown in FIG. 4, at the sheet conveying control section, in contrast to the preceding image-receiving medium 12A(F) which is being conveyed at the predetermined conveying speed (low speed) V1 at the time of the heat developing transfer processing, control is effected such that the subsequent image-receiving medium 12A(L) is conveyed at the predetermined high-speed conveying speed V2, and the subsequent image-receiving medium 12A(L) is set in a state in which the leading end thereof is positioned accurately at a position separated by a predetermined short interval D from the trailing end of the preceding image-receiving medium 12A(F).

Moreover, in the sheet conveying control section, control is effected such that the conveying speed of the subsequent image-receiving medium 12A(L) is switched from the high-speed conveying speed V2 to the predetermined conveying speed (low speed) V1 at the time of heat developing transfer processing, and the preceding image-receiving medium 12A (F) and the subsequent image-receiving medium 12A(L) are conveyed into the heat developing transfer section in a state in which there is the predetermined short interval D therebetween.

Even in a case in which the sizes (conveying direction lengths) of the preceding image-receiving medium 12A(F) and the subsequent image-receiving medium 12A(L) are different, control can be effected such that they are conveyed into the heat developing transfer section in a state in which there is the predetermined short interval D therebetween.

Note that, the next image-receiving media 12A, which follow next after the subsequent image-receiving medium 12A(L), also are conveyed in accordance with the above-described control operations effected by the sheet conveying control section for the preceding image-receiving medium 12A(F) and the subsequent image-receiving medium 12A (L). In this way, the next image-receiving media 12A are successively conveyed into the heat developing transfer section in a state in which there is the predetermined short interval D therebetween.

The heat developing transfer section in the image forming device is structured as the image transfer device shown in FIG. 1.

The drum 52 for heat developing, a belt supporting mechanism 54 disposed so as to correspond to the heating region of the drum 52 for heat developing, and a laminating roller 56 are installed in this heat developing transfer section.

The laminating roller 56 is disposed at a position adjacent to the water applying section, which position lies in the direction of the conveying direction upstream side of the drum 52 for heat developing. The laminating roller 56 is structured as a roller whose outer peripheral surface is covered by silicon rubber.

The laminating roller 56 is urged so as to press-contact the outer peripheral surface of the drum 52 for heat developing at a predetermined press-contact pressure, by pressure-applying means provided at bearing portions at the longitudinal direction both end portions of the laminating roller 56.

The drum 52 for heat developing has a drum surface portion which is formed in the shape of a hollow cylinder and of aluminum. Although not illustrated, shaft portions provided at both axial direction end portions of the drum 52 for heat developing are disposed so as to be freely rotatably received by shaft receiving mechanisms provided at structural members of the image forming device main body 10.

A halogen lamp (not illustrated), which serves as a heating means for raising the temperature of the surface of the drum surface portion (to about 82° C. for example), is disposed at the interior of the drum 52 for heat developing. The halogen lamp is driven and controlled by an unillustrated temperature control circuit.

In the belt supporting mechanism 54 disposed in the heat developing transfer section, an endless belt 60 is trained around five training rollers 62, 64, 66, 68, 70. The portion of the endless belt 60 extending between the conveying direction upstream side training roller 62 and the conveying direction downstream side training roller 70 is structured so as to press-contact the outer peripheral surface of the drum 52 for heat developing which outer peripheral surface corresponds to the heating region.

The training rollers 62, 64, 66, which serve to guide the endless belt 60, are structured by rollers made of stainless steel. The training roller 70 which is for driving of the endless belt 60 is structured by a rubber roller. The endless belt 60 used in the belt supporting mechanism 54 is structured by forming a woven fabric material into an endless belt and covering the surface thereof with silicon rubber.

The training roller 70 for driving is structured so as to be driven to rotate due to the drive force of an unillustrated drive source (motor) being transferred thereto via a drive system.

In the belt supporting mechanism 54, due to the training roller 70 for driving being driven to rotate by the unillustrated drive source via the drive system, the endless belt 60 trained around the training roller 70 for driving is operated so as to rotate in a circulating manner. At this time, the endless belt 60 is operated so as to rotate in a circulating manner while directly press-contacting the surface of the drum 52 for heat developing, or while indirectly press-contacting the surface of the drum 52 for heat developing via the image-receiving medium 12A and the photosensitive material 16A which are superposed together as will be described later. Therefore, due to the frictional force applied between the endless belt 60 and the drum 52 for heat developing, the operation force of the endless belt 60 is transmitted to the drum 52 for heat developing, and the drum 52 for heat developing rotates thereby.

In the heat developing transfer section, the image-receiving medium 12A which has been conveyed in, and the photosensitive material 16A, which has been conveyed in and which is larger around the entire periphery thereof than the image-receiving medium 12A, are superposed together. Therefore, the image-receiving medium 12A and the photosensitive material 16A are fed in between the laminating roller 56 and the heating drum 52 in a state in which the photosensitive material 16A, which is larger around the entire periphery thereof than the image-receiving medium 12A, precedes the image-receiving medium 12A by a predetermined length.

The photosensitive material 16A and the image-receiving medium 12A, which have been fed-in in this way, are set in a state of being superposed together while being pressed to contact one another between the laminating roller 56 and the heating drum 52. Thereafter, the photosensitive material 16A and the image-receiving medium 12A are conveyed to the position of the training roller 62 on the drum 52 for heat developing. Here, while the superposed state is maintained due to the photosensitive material 16A and the image-receiving medium 12A being nipped between the drum 52 for heat developing and the endless belt 60, the photosensitive material 16A and the image-receiving medium 12A are heated while being conveyed through the heating region of the drum 52 for heat developing (the region between the training roller 62 and the training roller 70).

When the photosensitive material 16A and the image-receiving medium 12A are heated and pressed to contact one another in the state of being superposed in this way, the photosensitive material 16A and the image-receiving medium 12A are in a state of being laminated together while being fit tightly together. The photosensitive material 16A releases movable dyes, and simultaneously, these dyes are transferred to the dye fixing layer of the image-receiving medium 12A, such that an image is formed on the image-receiving medium 12A.

Note that, at the point in time when the photosensitive material 16A and the image-receiving medium 12A which are superposed together are disposed completely between the drum 52 for heat developing and the endless belt 60, rotation of the drum 52 for heat developing may be temporarily stopped and heating carried out.

As shown in FIG. 1, in the heat developing transfer section in the image forming device main body 10, when the photosensitive material 16A and the image-receiving medium 12A are conveyed through the heating region of the drum 52 for heat developing and the heat developing transfer processing is completed and the photosensitive material 16A and the image-receiving medium 12A are conveyed out from the training roller 70 for driving, a peeling claw 72 is operated to move by an unillustrated driving mechanism. The peeling claw 72 engages with the leading end portion of the photosensitive material 16A, which has been used and which is being conveyed so as to precede the image-receiving medium 12A by a predetermined length, and peels the leading end portion of the used photosensitive material 16A off from the outer peripheral surface of the drum 52 for heat developing.

Thereafter, the peeling claw 72 is operated to return, and the used photosensitive material 16A, which has been peeled off, is conveyed out into a waste photosensitive material accommodating box 74 and stacked therein.

The image-receiving medium 12A, from which the used photosensitive material 16A has been peeled off and to which an image has been transferred and which is being conveyed while still being fit tightly to the drum 52 for heat developing, is peeled off from the outer peripheral surface of the drum 52 for heat developing by a peeling claw member 76 from the leading end portion of the image-receiving medium 12A.

The image-receiving medium 12A, to which an image has been transferred and which has been peeled off in this way, is, while being conveyed on a conveying path, subjected to drying processing in an unillustrated drying section, and thereafter, is discharged out onto an unillustrated tray which is set at the exterior of the image forming device main body 10.

By successively repeating the above-described operations, the image forming device main body 10 continuously carries out image recording processing of plural sheets.

Description has been given of a case in which, in the above-described processing operations carried out by the image forming device main body 10, one of the photosensitive material 16A and one of the image-receiving medium 12A are superposed together, and heat developing transfer processing is carried out on a single image basis. However, the following structure is possible: a plurality of images are exposed onto a single photosensitive material 16A such that a plurality of latent images are formed thereon, and the image-receiving media 12A are superposed onto the respective portions at which the respective latent images are formed on the single photosensitive material 16A, and heat developing transfer processing is carried out.

Figure 5:
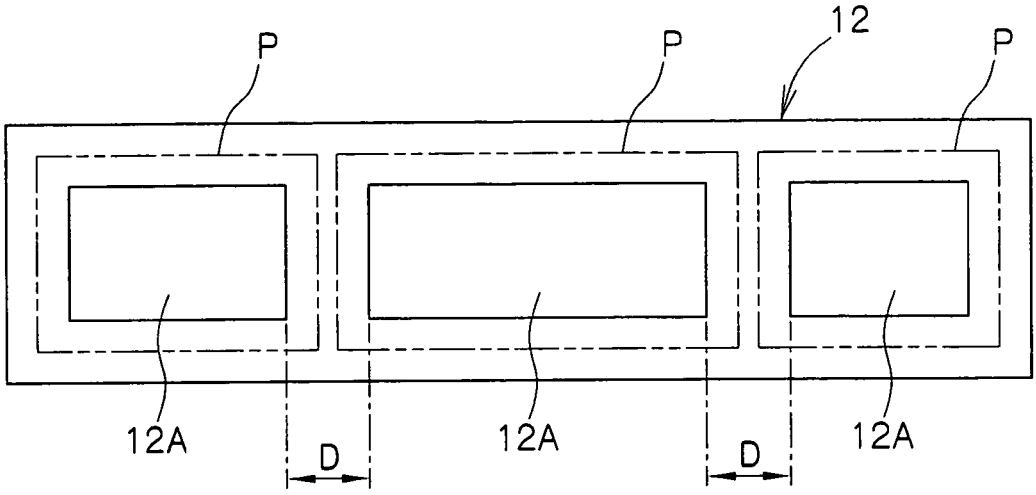
FIG. 5 is a front view showing a structure in which a single photosensitive material and a plurality of image-receiving media are stacked together and integral, which structure is an object of heat developing transfer processing by the image forming device equipped with the sheet conveying device relating to the embodiment of the present invention.

Namely, in this case, as shown in FIG. 5, the image-receiving media 12A (the image-receiving media 12A of sizes corresponding to the image sizes are used) are superposed onto respective portions P of the single photosensitive material 16A, at which portions P the plural latent images are formed. Heat developing transfer processing is carried out in a state in which the single photosensitive material 16A and the plural image-receiving media 12A are superposed and made integral.

In particular, in a case in which image forming processing is carried out in this way, the plural latent images must be formed so as to be lined up in the conveying direction at predetermined short intervals with respect to the single photosensitive material 16A, and the respective image-receiving media 12A must be superposed accurately on the positions at which the respective latent images are formed.

Therefore, in the image forming device main body 10, the sheet conveying control section makes the intervals, between the image-receiving media 12A at the time when the respective image-receiving media 12A are superposed on the positions at which the respective latent images are formed, coincide with the predetermined short interval D between the trailing end of the preceding image-receiving medium 12A(F) and the leading end of the subsequent image-receiving medium 12A(L) at the time when they are conveyed by the sheet conveying control section. Heat developing transfer processing can thereby be carried out appropriately.

Description has been given of a case in which, in the above-described image forming device main body 10, the sheet conveying control section is provided at the switch-back standby section 46 corresponding to the image-receiving paper magazine 14. However, the sheet conveying control section may of course be provided at the switch-back standby section 26 corresponding to the donor magazine 18.

Other Structural Examples of the Sheet Conveying Control Means

Next, another structural example of the sheet conveying control section in the image forming device main body 10 will be described with reference to FIGS. 6 through 9.

Figure 6:
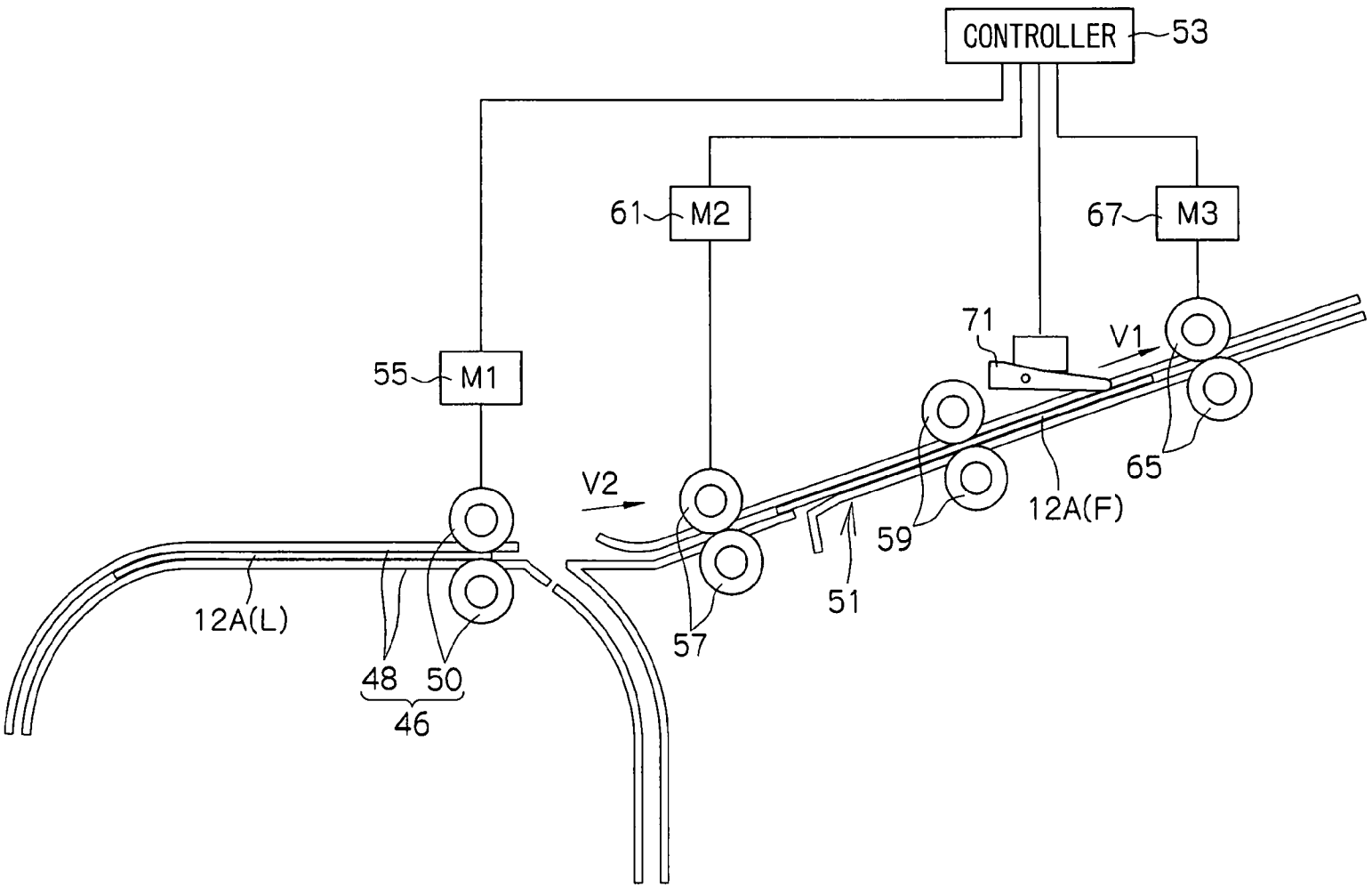
FIG. 6 is a schematic structural explanatory diagram at the time when a both end portion detecting sensor detects a leading end portion of a preceding image-receiving medium, and shows main portions of a sheet conveying device of another structure provided at the image forming device relating to the embodiment of the present invention.

In this other structural example of the sheet conveying control section, which other structural example is illustrated in FIG. 6, the rollers 50 for leading end standby of the image-receiving paper, which rollers 50 are connected to the output shaft of the forward/reverse driving motor 55 which is controlled by the control device 53, are disposed at the entrance of the switch-back standby section 46.

Further, the two sets of variable conveying rollers 57, 59, which are connected to the output shaft of the variable pulse motor 61 controlled by the control device 53 such that the conveying speeds of the variable conveying rollers 57, 59 can be varied between V1 and V2, are disposed at the conveying direction downstream side of the rollers 50 for leading end standby.

A both end portion detecting sensor 71, for detecting the leading end and the trailing end of the image-receiving medium 12A, is disposed at a predetermined position at the conveying direction downstream side of the variable conveying rollers 59 and at the conveying direction upstream side of the feed-out conveying rollers 65. The both end portion detecting sensor 71 is structured so as to transmit, to the control device 53, a detection signal at the time when the both end portion detecting sensor 71 detects the leading end or the trailing end of the image-receiving medium 12A which is conveyed-in.

The feed-out conveying rollers 65 are disposed at a predetermined position from the both end portion detecting sensor 71 at the conveying direction downstream side thereof. The feed-out conveying rollers 65 are connected to the output shaft of the pulse motor 67 controlled by the control device 53 (a variable pulse motor is used in a case in which the conveying speed must be changed between V1 and V2). The feed-out conveying rollers 65 are structured so as to be able to convey the image-receiving medium 12A at a predetermined conveying speed (low speed) V1 at the time of heat developing transfer processing, which is synchronous with the drum 52 for heat developing in the heat developing transfer section.

Next, the control operations in this other structural example of the sheet conveying control section, which is illustrated in FIGS. 6 through 9 and is structured as described above, at the time when the image-receiving media 12A are successively conveyed accurately at uniform, short intervals, will be explained.

In this other structural example of the sheet conveying control section illustrated in FIGS. 6 through 9, the image-receiving paper roll 12 housed in the image-receiving paper magazine 14 is pulled out and cut to a predetermined size by the cutter 44, such that the preceding image-receiving medium 12A(F) serving as a preceding sheet is formed. This preceding image-receiving medium 12A(F) is conveyed into the switch-back standby section 46 for the image-receiving paper.

Thereafter, the preceding image-receiving medium 12A (F) serving as a preceding sheet is conveyed on the conveying path 51 for supply of the image-receiving paper to the heat developing transfer section at the high-speed conveying speed V2. The leading end of the preceding image-receiving medium 12A(F) is detected by the both end portion detecting sensor 71, and the detection signal therefor is transmitted to the control device 53.

Therefore, the control device 53 of the sheet conveying control section drives the variable pulse motor 61 (and the pulse motor 67 if necessary) at high speed and for a predetermined period of time from the point in time when the both end portion detecting sensor 71 detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Note that, in this sheet conveying control section, control may be effected as follows: the control device 53 drives, at high speed and for a predetermined number of pulses, the variable pulse motor 61 (and the pulse motor 67 if necessary) from the point in time when the both end portion detecting sensor 71 detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

At the sheet conveying control section, while the preceding image-receiving medium 12A(F) is being conveyed on the conveying path 51 for supply, the leading end portion of the image-receiving paper roll 12 within the image-receiving paper magazine 14 is pulled-out and the image-receiving paper roll 12 is cut by the cutter 44. This subsequent image-receiving medium 12A(L) serving as a subsequent sheet is conveyed into the switch-back standby section 46 for the image-receiving paper, is nipped by the rollers 50 for leading end standby, and is made to stand-by in the switch-back standby section 46 for the image-receiving paper.

Figure 7:
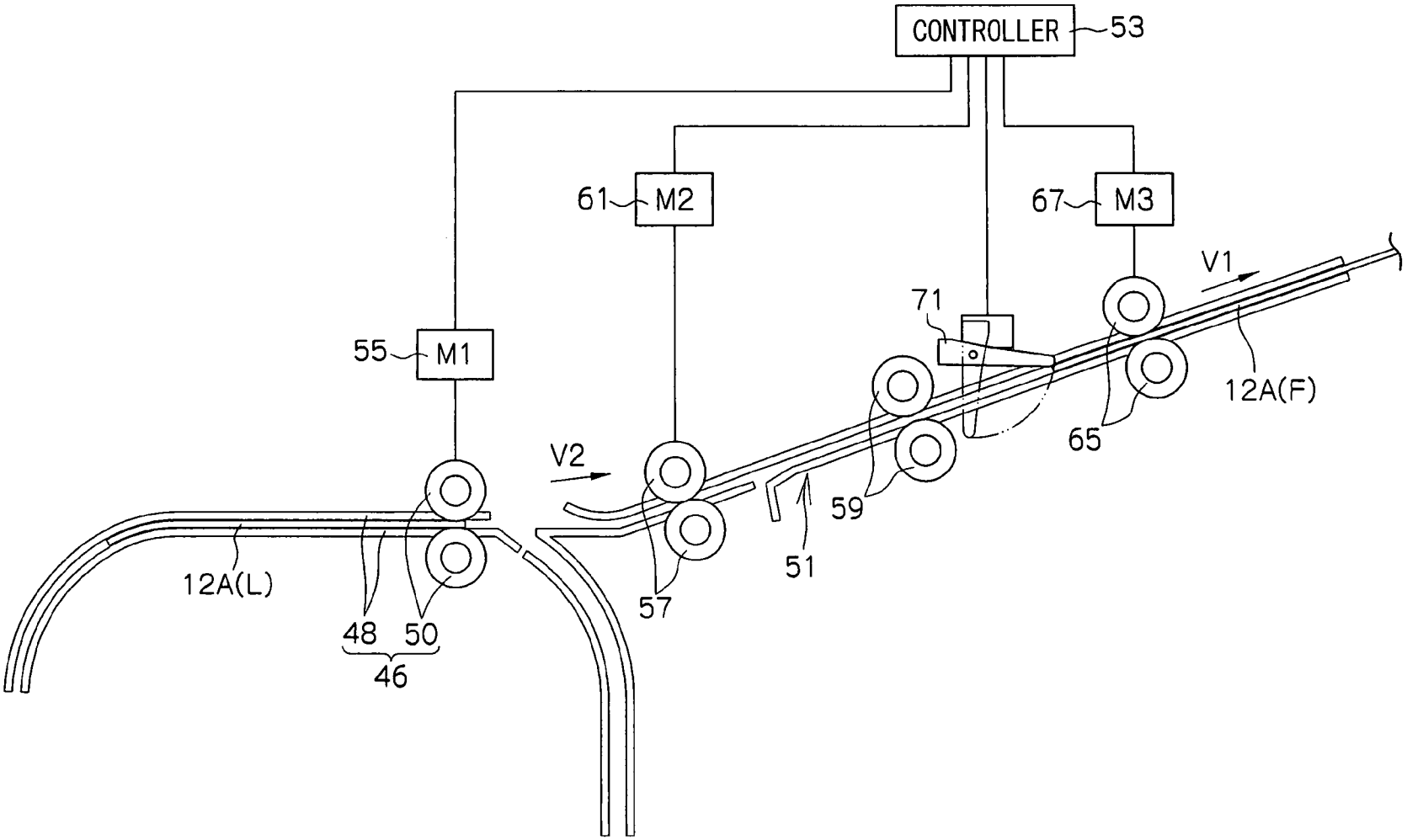
FIG. 7 is a schematic structural explanatory diagram at the time when the both end portion detecting sensor detects a trailing end of the preceding image-receiving medium, and shows main portions of the sheet conveying device of the other structure provided at the image forming device relating to the embodiment of the present invention.

As shown in FIG. 7, at the sheet conveying control section, while the preceding image-receiving medium 12A (F) is conveyed out along the conveying path 51 for supply of the image-receiving paper toward the heat developing transfer section, when the both end portion detecting sensor 71 detects the trailing end of the preceding image-receiving medium 12A(F), the both end portion detecting sensor 71 transmits the detection signal therefor to the control device 53.

The control device 53, which has received the detection signal of the both end portion detecting sensor 71, drives the forward/reverse driving motor 55 at high speed and reversely rotates the rollers 50 for leading end standby, such that the subsequent image-receiving medium 12A (L) is conveyed out onto the conveying path 51 for supply of the image-receiving paper at the predetermined high-speed conveying speed V2.

Moreover, the control device 53 drives the variable pulse motor 61. The variable conveying rollers 57, 59 are driven to rotate, and the subsequent image-receiving medium 12A (L) is conveyed along the conveying path 51 for supply of the image-receiving paper at the predetermined high-speed conveying speed V2.

Figure 8:
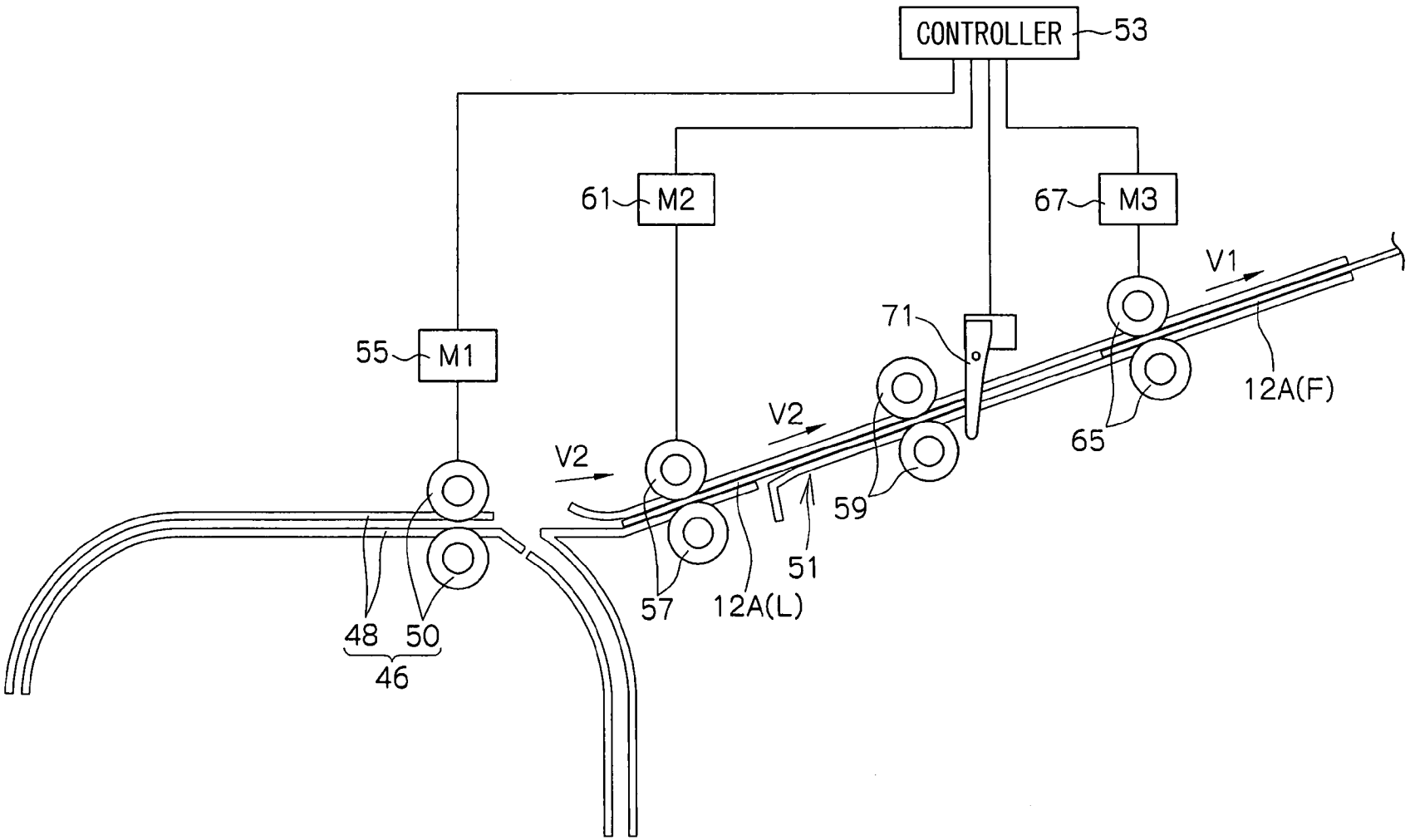
FIG. 8 is a schematic structural explanatory diagram at the time when the both end portion detecting sensor detects a leading end portion of a subsequent image-receiving medium, and shows main portions of the sheet conveying device of the other structure provided at the image forming device relating to the embodiment of the present invention.

As shown in FIG. 8, when the leading end of the subsequent image-receiving medium 12A(L) which has been conveyed in at the high-speed conveying speed V2 is detected by the both end portion detecting sensor 71 and the detection signal therefor is transmitted to the control device 53, the control device 53 of the sheet conveying control section drives the variable pulse motor 61 (and the pulse motor 67 if necessary) at a high speed and for a predetermined period of time from the point in time when the both end portion detecting sensor 71 detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Figure 9:
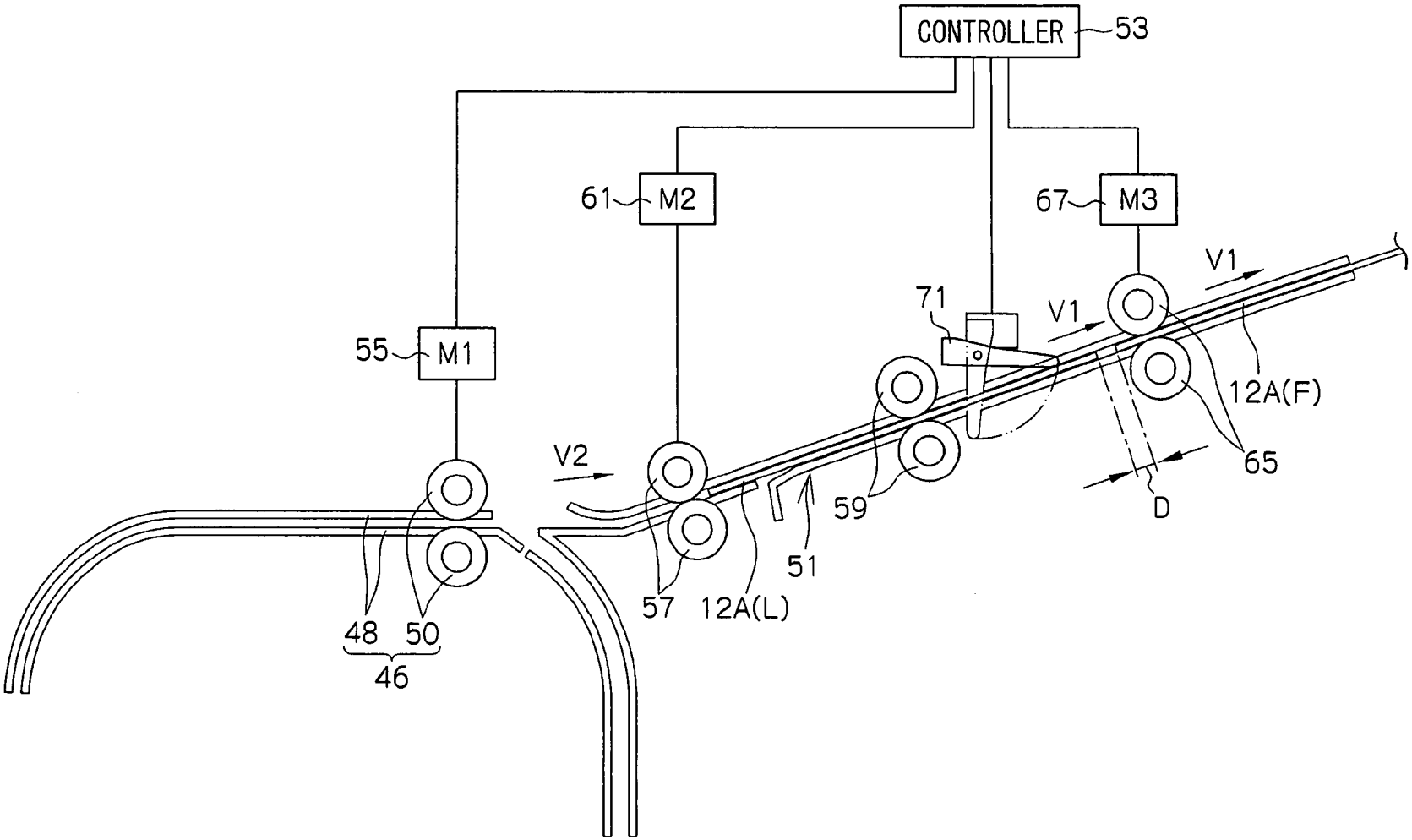
FIG. 9 is a schematic structural explanatory diagram at the time when the preceding image-receiving medium and the subsequent image-receiving medium become set at a predetermined interval from one another, and shows main portions of the sheet conveying device of the other structure provided at the image forming device relating to the embodiment of the present invention.

As shown in FIG. 9, at the sheet conveying control section, in contrast to the preceding image-receiving medium 12A(F) which is being conveyed at the predetermined conveying speed (low speed) V1 at the time of the heat developing transfer processing, control is effected such that the subsequent image-receiving medium 12A(L) is conveyed at the predetermined high-speed conveying speed V2, such that the subsequent image-receiving medium 12A (L) is set in a state in which the leading end thereof is accurately positioned at a position which is set apart by the predetermined short interval D from the trailing end of the preceding image-receiving medium 12A(F).

Moreover, in the sheet conveying control section, control is effected such that the conveying speed of the subsequent image-receiving medium 12A(L) is switched from the high-speed conveying speed V2 to the predetermined conveying speed (low speed) V1 at the time of the heat developing transfer processing, and the preceding image-receiving medium 12A(F) and the subsequent image-receiving medium 12A(L) are conveyed into the heat developing transfer section in a state in which there is the predetermined short interval D therebetween.

Here, the next image-receiving media 12A, which follow after the subsequent image-receiving medium 12A(L), also are conveyed in accordance with the above-described control operations effected by the sheet conveying control section for the preceding image-receiving medium 12A (F) and the subsequent image-receiving medium 12A(L). In this way, these next image-receiving media 12A are successively conveyed into the heat developing transfer section in a state in which there is the predetermined short interval D therebetween.

Description has been given of a case in which the above-described sheet conveying control section illustrated in FIGS. 6 through 9 is structured such that one both end portion detecting sensor 71 is provided on the conveying path 51 for supply. However, a leading end portion detecting sensor which detects the leading end of the image-receiving medium 12A and a trailing end portion detecting sensor which detects the trailing end of the image-receiving medium 12A may be provided separately, and the leading end portion detecting sensor and the trailing end portion detecting sensor may be disposed at different predetermined positions on the conveying path 51 for supply.

In the sheet conveying control section illustrated in FIGS. 6 through 9, the structures, operations and effects other than those described above are similar to those of the previously-described sheet conveying control section illustrated in FIGS. 2 through 4, and therefore, description thereof will be omitted.

Next, yet another structural example of the sheet conveying control section in the image forming device main body 10 will be described with reference to FIGS. 10 through 14.

Figure 10:
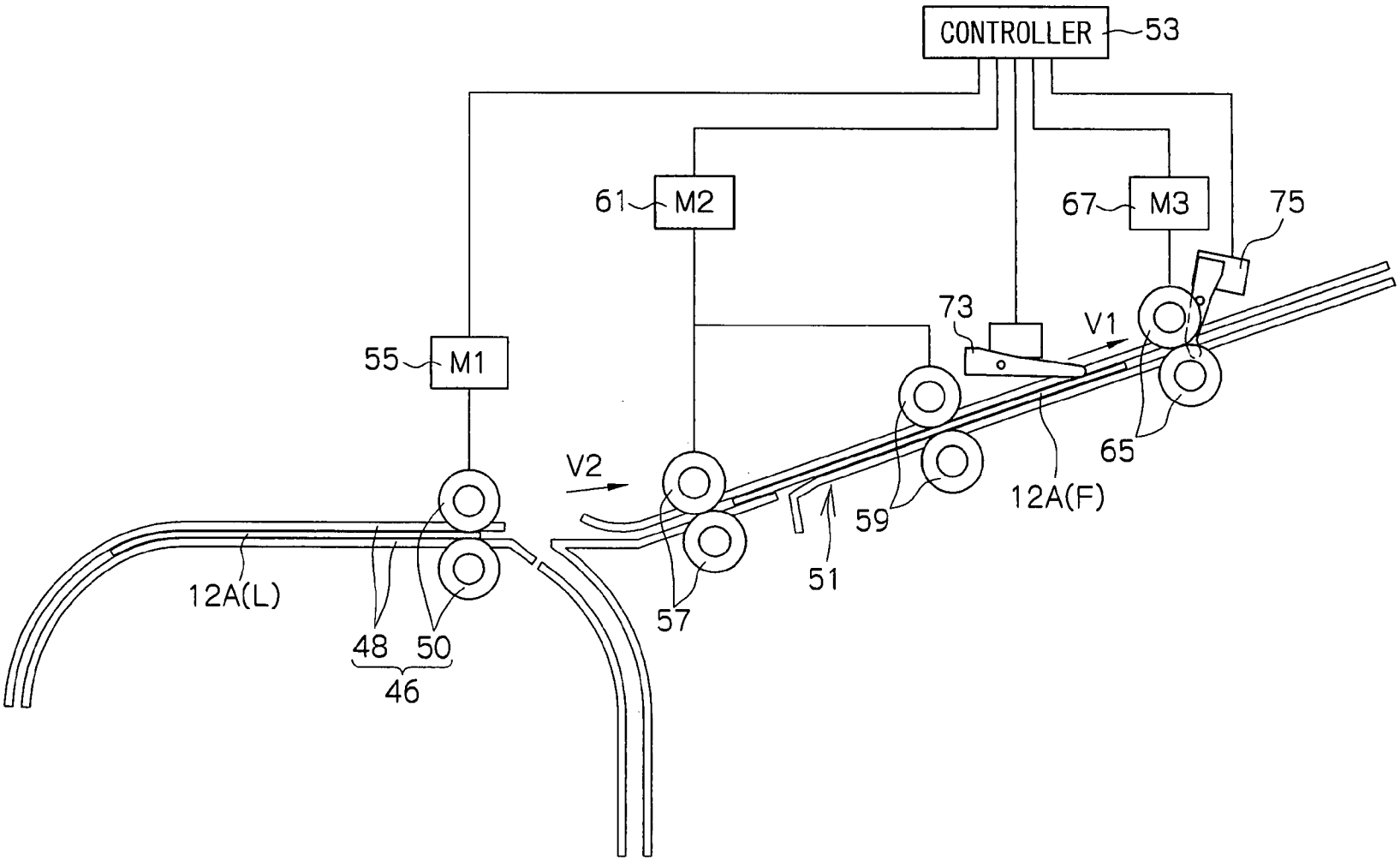
FIG. 10 is a schematic structural explanatory diagram at the time when one end portion detecting sensor detects a leading end portion of a preceding image-receiving medium, and shows main portions of a sheet conveying device of yet another structure provided at the image forming device relating to the embodiment of the present invention.

In this yet another structural example of the sheet conveying control section, which structural example is illustrated in FIG. 10, the rollers 50 for leading end standby of the image-receiving paper, which rollers 50 are connected to the output shaft of the forward/reverse driving motor 55 which is controlled by the control device 53, are disposed at the entrance of the switch-back standby section 46.

Further, the two sets of variable conveying rollers 57, 59, which are connected to the output shaft of the variable pulse motor 61 controlled by the control device 53 such that the conveying speeds of the variable conveying rollers 57, 59 can be varied between V1 and V2, are disposed at the conveying direction downstream side of the rollers 50 for leading end standby.

A first end portion detecting sensor 73 for leading end detection, which is for detecting the leading end portion of the image-receiving medium 12A, is disposed at a predetermined position at the conveying direction downstream side of the variable conveying rollers 59. The first end portion detecting sensor 73 for leading end detection is structured so as to transmit, to the control device 53, a detection signal at the time when the first end portion detecting sensor 73 for leading end detection detects the leading end portion of the image-receiving medium 12A which is conveyed-in.

The feed-out conveying rollers 65 are disposed at a predetermined position from the first end portion detecting sensor 73 for leading end detection at the conveying direction downstream side thereof. The feed-out conveying rollers 65 are connected to the output shaft of the pulse motor 67 controlled by the control device 53 (a variable pulse motor is used in a case in which the conveying speed must be changed between V1 and V2). The feed-out conveying rollers 65 are structured so as to be able to convey the image-receiving medium 12A at a predetermined conveying speed (low speed) V1 at the time of heat developing transfer processing which is synchronous with the drum 52 for heat developing in the heat developing transfer section.

A second end portion detecting sensor 75 for leading end detection, which is for detecting the leading end portion of the image-receiving medium 12A, is disposed at an adjacent position at the conveying direction downstream side of the feed-out conveying rollers 65. The second end portion detecting sensor 75 for leading end detection is structured so as to transmit, to the control device 53, a detection signal at the time when the second end portion detecting sensor 75 for leading end detection detects the leading end portion of the image-receiving medium 12A which is conveyed-in.

Next, the control operations at the time when, while a plurality of image-receiving media 12A are being successively conveyed at the sheet conveying control section structured as described above, the image-receiving media 12A are conveyed accurately with the intervals between the leading ends of two adjacent image-recording media 12A being a constant interval, will be described in accordance with FIGS. 10 through 14.

In this sheet conveying control section, the leading end portion of the image-receiving paper roll 12 housed in the image-receiving paper magazine 14 is pulled out, and the image-receiving paper roll 12 is cut to the image-receiving medium 12A of a predetermined size by the cutter 44. This preceding image-receiving medium 12A(F), which serves as a preceding sheet and which is conveyed into the switch-back standby section 46 for the image-receiving paper and stands-by in a state of being nipped by the rollers 50 for leading end standby, is conveyed on the conveying path 51 for supply of the image-receiving paper toward the heat developing transfer section due to the rollers 50 for leading end standby being rotated reversely at the necessary time for preparations to be made for the heat developing transfer processing of the photosensitive material 16A.

Further, while the preceding image-receiving medium 12A(F) is being conveyed on the conveying path 51 for supply, the sheet conveying control section causes the leading end portion of the image-receiving paper roll 12 within the image-receiving paper magazine 14 to be pulled-out, and the image-receiving paper roll 12 to be cut by the cutter 44 and conveyed into the switch-back standby section 46 for the image-receiving paper and nipped by the rollers 50 for leading end standby. The sheet conveying control section causes this subsequent image-receiving medium 12A(L), which serves as a subsequent sheet, to stand-by at the switch-back standby section 46 for the image-receiving paper as shown in FIG. 10.

As shown in FIG. 10, at the sheet conveying control section, while the preceding image-receiving medium 12A (F) is conveyed on the conveying path 51 for supply of the image-receiving paper out toward the heat developing transfer section, when the first end portion detecting sensor 73 detects the leading end of the preceding image-receiving medium 12A(F) which has been conveyed in at the high-speed conveying speed V2 and transmits a detection signal therefor to the control device 53, the control device 53 of the sheet conveying control section drives the variable pulse motor 61 (and the pulse motor 67 if necessary) at a high speed and for a predetermined period of time from the point in time when the first end portion detecting sensor 73 detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Note that, in this sheet conveying control section, control may be effected as follows: the control device 53 drives, at high speed and for a predetermined number of pulses, the variable pulse motor 61 (and the pulse motor 67 if necessary) from the point in time when the first end portion detecting sensor 73 detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Figure 11:
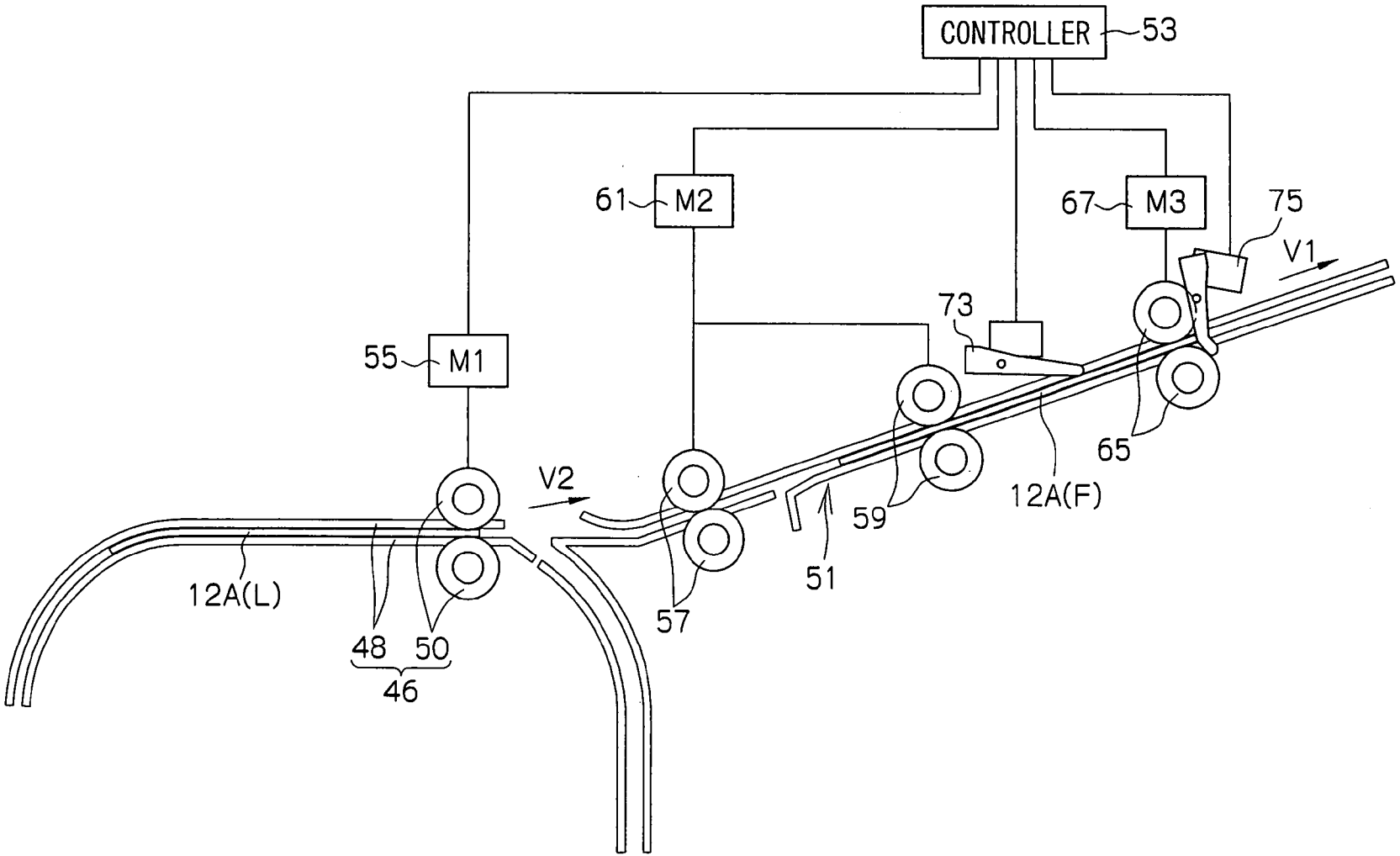
FIG. 11 is a schematic structural explanatory diagram at the time when another end portion detecting sensor detects a trailing end of the preceding image-receiving medium, and shows main portions of the sheet conveying device of the yet another structure provided at the image forming device relating to the embodiment of the present invention.

Next, as shown in FIG. 11, when the preceding image-receiving medium 12A(F) is conveyed out further toward the heat developing transfer section along the conveying path 51 for supply of the image-receiving paper at the predetermined conveying speed (low speed) V1 at the time of the heat developing transfer processing (which is a relatively slow speed), and the second end portion detecting sensor 75 detects the leading end of the preceding image-receiving medium 12A(F), the second end portion detecting sensor 75 transmits the detection signal therefor to the control device 53.

Note that, at this time, the preceding image-receiving medium 12A(F) is being conveyed at the predetermined conveying speed (low speed) V1 which is a relatively slow speed. Therefore, the second end portion detecting sensor 75 can more accurately detect the leading end of the preceding image-receiving medium 12A(F). Accordingly, the interval between the leading end of the preceding image-receiving medium 12A(F) and the leading end of the subsequent image-receiving medium 12A(L), which interval is controlled and set as will be described later, can be accurately set to a predetermined interval E.

Therefore, the control device 53, which has received the detection signal of the second end portion detecting sensor 75, drives the forward/reverse driving motor 55 at high speed such that the rollers 50 for leading end standby are rotated reversely, and the subsequent image-receiving medium 12A(L) is conveyed out onto the conveying path 51 for supply of the image-receiving paper at the predetermined high-speed conveying speed V2.

Figure 12:
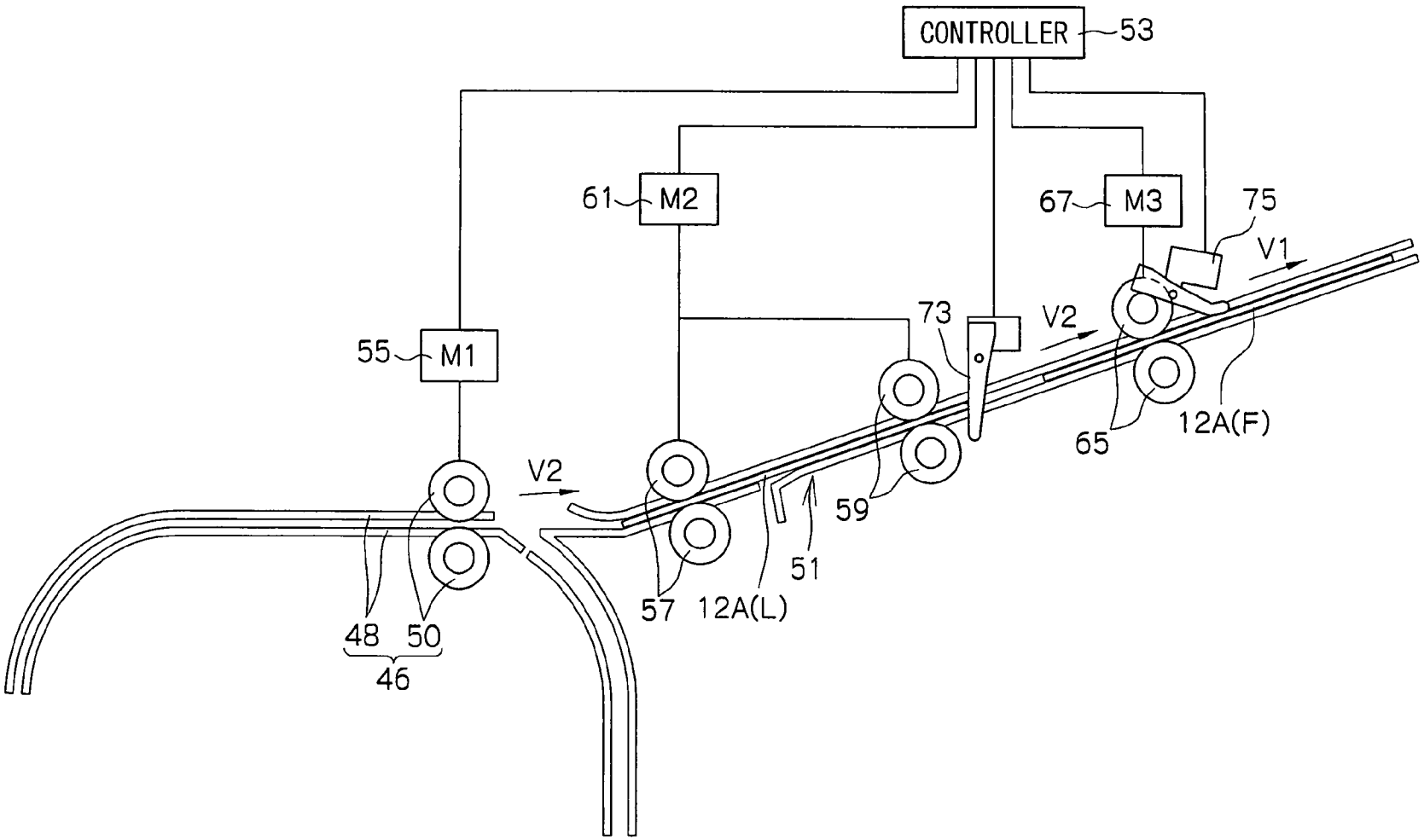
FIG. 12 is a schematic structural explanatory diagram at the time when the one end portion detecting sensor detects a leading end portion of a subsequent image-receiving medium, and shows main portions of the sheet conveying device of the yet another structure provided at the image forming device relating to the embodiment of the present invention.

As shown in FIG. 12, when the end portion detecting sensor 73 detects the leading end of the subsequent image-receiving medium 12A(L) which has been conveyed in at the high-speed conveying speed V2 and transmits a detection signal therefor to the control device 53, the control device 53 of the sheet conveying control section drives the variable pulse motor 61 (and the pulse motor 67 if necessary) at a high speed and for a predetermined period of time from the point in time when the end portion detecting sensor 73 detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Note that, in this sheet conveying control section, control may be effected as follows: the control device 53 drives, at high speed and for a predetermined number of pulses, the variable pulse motor 61 (and the pulse motor 67 if necessary) from the point in time when the end portion detecting sensor 73 detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Figure 13:
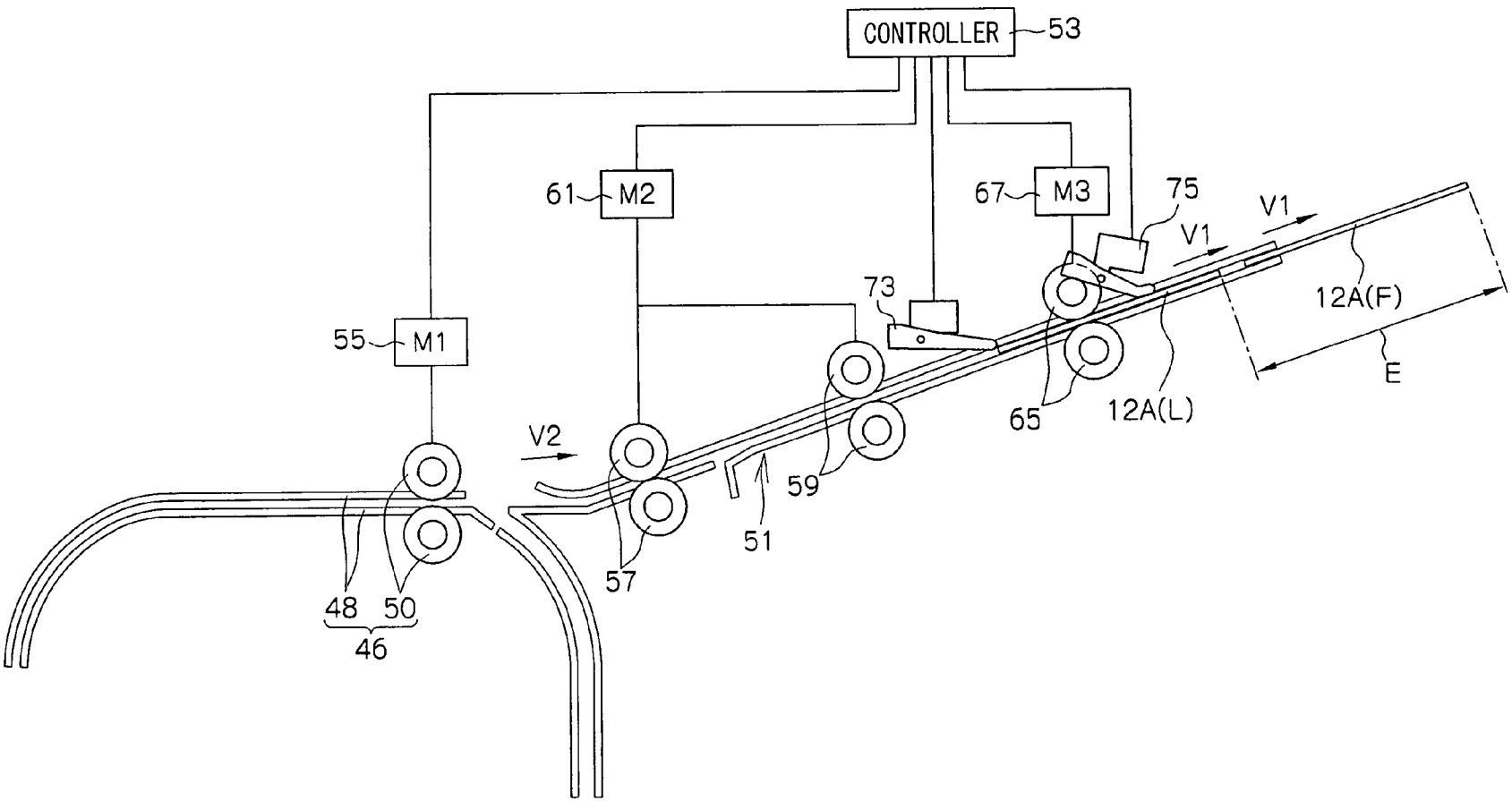
FIG. 13 is a schematic structural explanatory diagram at the time when the leading end of the preceding image-receiving medium and the leading end of the subsequent image-receiving medium become set at a predetermined interval from one another, and shows main portions of the sheet conveying device of the yet another structure provided at the image forming device relating to the embodiment of the present invention.
Figure 14:
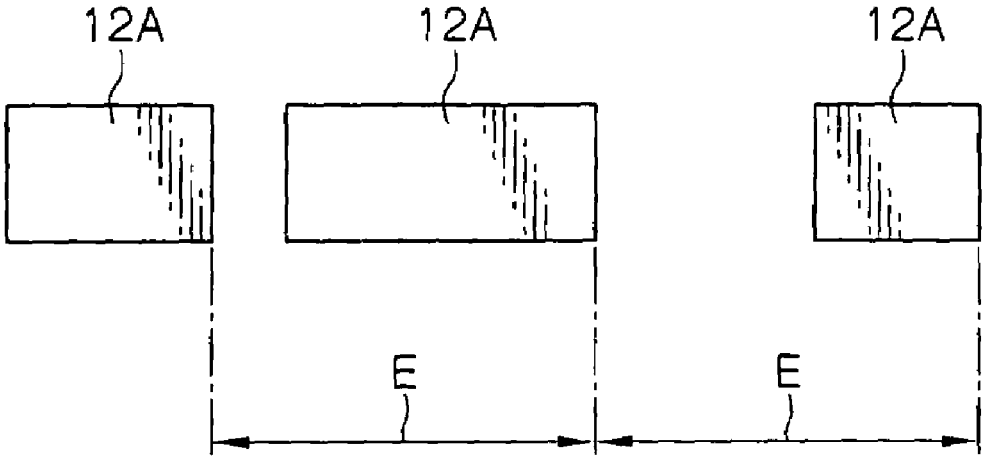
FIG. 14 is a front view showing a state in which a plurality of image-receiving media, which are objects of heat developing transfer processing by the image forming device equipped with the sheet conveying device relating to the embodiment of the present invention, are conveyed such that intervals between respective leading ends thereof are uniform.

As shown in FIGS. 13 and 14, due to the sheet conveying control section effecting control as described above, in contrast to the preceding image-receiving medium 12A(F) which is being conveyed at the predetermined conveying speed (low speed) V1 at the time of the heat developing transfer processing, control is effected such that the subsequent image-receiving medium 12A(L) is conveyed at the predetermined high-speed conveying speed V2, such that the interval between the leading end of the preceding image-receiving medium 12A(F) and the leading end of the subsequent image-receiving medium 12A(L), is in a state of being the predetermined interval E.

Moreover, in the sheet conveying control section, control can be effected such that the conveying speed of the subsequent image-receiving medium 12A(L) is switched from the high-speed conveying speed V2 to the predetermined conveying speed (low speed) V1 at the time of the heat developing transfer processing, and the leading end of the preceding image-receiving medium 12A(F) and the leading end of the subsequent image-receiving medium 12A(L) are successively conveyed into the heat developing transfer section in a state in which there is the predetermined interval E therebetween.

Note that, the next image-receiving media 12A, which follow after the subsequent image-receiving medium 12A (L), also are conveyed in accordance with the above-described control operations effected by the sheet conveying control section for the preceding image-receiving medium 12A(F) and the subsequent image-receiving medium 12A (L). In this way, the next image-receiving media 12A are successively conveyed into the heat developing transfer section in a state in which there is the predetermined short interval E between the respective leading ends thereof.

Next, explanation will be given of the control operations of the above-described sheet conveying control section shown in FIGS. 10 through 14 at the time when adjacent two image-receiving media 12A are conveyed with the interval between the leading ends thereof being a constant interval, in a case in which the above-described first end portion detecting sensor 73 for leading end detection which is for detecting the leading end portion of the image-receiving medium 12A is structured as a both end portion detecting sensor, and only this end portion detecting sensor 73 structured by one both end portion detecting sensor is used.

In a structural example using only the end portion detecting sensor 73 which is structured as a single both end portion detecting sensor in the conveying control section illustrated in FIGS. 10 through 14, the preceding image-receiving medium 12A(F), which serves as a preceding sheet and which has been conveyed into the switch-back standby section 46 for the image-receiving paper, is conveyed on the conveying path 51 for supply of the image-receiving paper toward the heat developing transfer section at the high-speed conveying speed V2. The leading end thereof is detected by the end portion detecting sensor 73 which is structured as a both end portion detecting sensor, and the detection signal therefor is transmitted to the control device 53.

Therefore, the control device 53 of the sheet conveying control section drives the variable pulse motor 61 (and the pulse motor 67 if necessary) at a high speed and for a predetermined period of time from the point in time when the end portion detecting sensor 73 serving as a both end portion detecting sensor detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Note that, in this sheet conveying control section, control may be effected as follows: the control device 53 drives, at high speed and for a predetermined number of pulses, the variable pulse motor 61 (and the pulse motor 67 if necessary) from the point in time when the end portion detecting sensor 73 structured as a both end portion detecting sensor detects the leading end of the preceding image-receiving medium 12A(F). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

Further, at the sheet conveying control section, while the preceding image-receiving medium 12A(F) is being conveyed on the conveying path 51 for supply, operation is carried out to cause the subsequent image-receiving medium 12A(L) serving as a subsequent sheet to standby at the switch-back standby section 46 for the image-receiving paper.

At the point in time when a predetermined time period (the time for the predetermined interval E to arise between the leading end of the preceding image-receiving medium 12A (F) and the leading end of the subsequent image-receiving medium 12A(L)) has elapsed from the point in time that the end portion detecting sensor 73 structured as a both end portion detecting sensor detects the leading end of the preceding image-receiving medium 12A(F), the control device 53 of the sheet conveying control section drives the forward/reverse motor 55 at high speed and reversely rotates the rollers 50 for leading end standby. Further, the control device 53 drives the variable pulse motor 61 and drives and rotates the variable conveying rollers 57, 59. The subsequent image-receiving medium 12A(L) is conveyed on the conveying path 51 for supply of the image-receiving paper at the predetermined high-speed conveying speed V2.

When the end portion detecting sensor 73 structured as a both end portion detecting sensor detects the leading end of the subsequent image-receiving medium 12A(L) which has been conveyed in at the high-speed conveying speed V2, and outputs the detection signal therefor to the control device 53, the control device 53 of the sheet conveying control section drives the variable pulse motor 61 (and the pulse motor 67 if necessary) at high speed and for a predetermined time period from the point in time when the end portion detecting sensor 73 structured as a both end portion detecting sensor detects the leading end of the subsequent image-receiving medium 12A(L). Thereafter, the control device 53 switches to a state of low-speed driving corresponding to the predetermined conveying speed (low speed) V1 at the time of the heat developing transfer processing which is synchronous with the drum 52 for heat developing in the heat developing transfer section.

In this way, the sheet conveying control section repeats the operations of, after conveying at the initial predetermined high-speed conveying speed V2, switching to and conveying at the predetermined conveying speed (low speed) V1 at the time of the heat developing transfer processing, at the point in time when a predetermined period of time has elapsed from the point in time when the end portion detecting sensor 73 structured as a both end portion detecting sensor detects the leading end of the image-receiving medium 12A(F). In this way, control can be effected so as to successively convey the image-receiving media 12A to the heat developing transfer section in a state in which the leading end of the preceding image-receiving medium 12A(F) and the leading end of the subsequent image-receiving medium 12A(L) are apart from one another by the predetermined interval E.

In accordance with the sheet conveying device of the present invention, there is the effect that sheet-shaped recording media can accurately be conveyed successively at uniform intervals, and, even when the sizes of the sheet-shaped recording media change, the intervals between sheet-shaped recording media which are conveyed before and after with respect to one another can be kept constant.

What is claimed is:

1. A sheet conveying device comprising:

a conveying path for supply which can convey a plurality of sheets while switching to one of a high-speed conveying speed and a low-speed conveying speed in a specific section;

a leading end portion detecting sensor disposed on the conveying path for supply;

a trailing end portion detecting sensor disposed on the conveying path for supply at a conveying direction downstream side of the leading end portion detecting sensor;

a control device which effects control so as to convey a subsequent sheet, which stands-by at a predetermined position, at the high-speed conveying speed under the condition that the trailing end portion detecting sensor has detected a trailing end of a preceding sheet which is conveyed at a low speed, and so as to decelerate and switch to the low speed conveying speed at a fixed time under the condition that the leading end portion detecting sensor has detected a leading end of the subsequent sheet; and a switch-back standby section disposed at a conveying direction upstream side of the conveying path for supply, and conveying a sheet, which has been conveyed in, into a conveying path set between a pair of guide members by rollers for leading end standby which are controlled to be driven to rotate by the control device, and causing the sheet to standby in a state in which one end portion of the sheet is nipped by the rollers for leading end standby, and due to the control device effecting control so as to reversely rotate the rollers for leading end standby at a necessary time, the switch-back standby section conveys the sheet out onto the conveying path for supply.

2. A sheet conveying device comprising:

a conveying path for supply which can convey a plurality of sheets while switching to one of a high-speed conveying speed and a low-speed conveying speed in a specific section;

a leading end portion detecting sensor disposed on the conveying path for supply;

a trailing end portion detecting sensor disposed on the conveying path for supply at a conveying direction downstream side of the leading end portion detecting sensor; and a control device which effects control so as to convey a subsequent sheet, which stands-by at a predetermined position, at the high-speed conveying speed under the condition that the trailing end portion detecting sensor has detected a trailing end of a preceding sheet which is conveyed at a low speed, and so as to decelerate and switch to the low speed conveying speed at a fixed time under the condition that the leading end portion detecting sensor has detected a leading end of the subsequent sheet;

wherein the conveying path has three motors which can be controlled by the control device, and roller pairs which are connected to and can be driven by the respective motors.

* * * * *